US008501086B2

(12) United States Patent
Ueyama et al.

(10) Patent No.: US 8,501,086 B2
(45) Date of Patent: Aug. 6, 2013

(54) NICKEL BASED ALLOY

(75) Inventors: Masaki Ueyama, Amagasaki (JP); Masaaki Terunuma, Osaka (JP); Satoshi Matsumoto, Houston, TX (US)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 12/888,492

(22) Filed: Sep. 23, 2010

(65) Prior Publication Data

US 2011/0236252 A1 Sep. 29, 2011

Related U.S. Application Data

(63) Continuation of application No. PCT/JP2009/055888, filed on Mar. 25, 2009.

(30) Foreign Application Priority Data

Mar. 25, 2008 (JP) ..... 2008-077436

(51) Int. Cl.
*C22C 19/05* (2006.01)

(52) U.S. Cl.
USPC ..... 420/445; 420/453

(58) Field of Classification Search
USPC ..... 420/443, 445, 453; 148/410
See application file for complete search history.

(56) References Cited

U.S. PATENT DOCUMENTS

| | | | | |
|---|---|---|---|---|
| 4,400,211 | A * | 8/1983 | Kudo et al. | 420/443 |
| 5,335,717 | A * | 8/1994 | Chin et al. | 164/519 |
| 6,623,869 | B1 * | 9/2003 | Nishiyama et al. | 428/685 |
| 6,764,646 | B2 * | 7/2004 | Crook et al. | 420/445 |

FOREIGN PATENT DOCUMENTS

| | | |
|---|---|---|
| CN | 1463296 | 12/2003 |
| EP | 1 382 696 | 1/2004 |
| JP | 61-201759 | 9/1986 |
| JP | 05-195126 | 8/1993 |
| JP | 05-247597 | 9/1993 |
| JP | 06-128699 | 5/1994 |
| JP | 07-214374 | 8/1995 |
| JP | 08-003666 | 1/1996 |
| JP | 08-252692 | 10/1996 |
| JP | 10-060603 | 3/1998 |
| JP | 2001-107196 | 4/2001 |
| JP | 2002-096111 | 4/2002 |
| JP | 2002-096171 | 4/2002 |
| JP | 2004-019005 | 1/2004 |

OTHER PUBLICATIONS

English Abstract and English Machine Translation of Inoue, et al. (JP 08-252692) (1996).*

* cited by examiner

*Primary Examiner* — Jessee R. Roe
(74) *Attorney, Agent, or Firm* — Clark & Brody

(57) ABSTRACT

A Ni based alloy, which consists of by mass percent, C≦0.03%, Si: 0.01 to 0.5%, Mn: 0.01 to 1.0%, P≦0.03%, S≦0.01%, Cr: not less than 20% to less than 30%, Ni: more than 40% to not more than 60%, Cu: more than 2% to not more than 5.0%, Mo: 4.0 to 10%, Al: 0.005 to 0.5% and N: more than 0.02% to not more than 0.3%, with the balance being Fe and impurities, and the expression of "0.5 Cu+Mo≧6.5" is satisfied, has excellent corrosion resistance equivalent to that of Ni based alloys having high Mo contents, such as Hastelloy C22 and Hastelloy C276, in severe corrosive environments containing reducing acids, such as hydrochloric acid and sulfuric acid, together with excellent workability. Therefore, it can be suitably used as a low-cost material for various kinds of structural members.

2 Claims, No Drawings

NICKEL BASED ALLOY

This application is a continuation of the international application PCT/JP2009/055888 filed on Mar. 25, 2009, the entire content of which is herein incorporated by reference.

TECHNICAL FIELD

The present invention relates to a Ni based alloy. More particularly, the present invention relates to a Ni based alloy having excellent corrosion resistance in severe corrosive environments containing reducing acids, such as hydrochloric acid (HCl) and sulfuric acid ($H_2SO_4$). In particular, it relates to a highly corrosion-resistant Ni based alloy which can be suitably used as a material for various kinds of structural members, such as those of air-cooled heat exchangers and air preheaters used in petroleum refineries, petrochemical plants and the like as well as those of flue-gas desulfurization equipment, flues, smokestacks and the like in thermal power stations.

BACKGROUND ART

In air-cooled heat exchangers and air preheaters used in petroleum refineries, petrochemical plants and the like as well as flue-gas desulfurization equipment used in thermal power stations and so on, not only sulfuric acid, but also a reducing acid which has a highly corrosive action, such as hydrochloric acid and so on, is generated when combustion gases are cooled. For this reason, it has been impossible to avoid the occurrence of corrosion in Fe based corrosion-resistant alloys, such as conventional low alloy steels and stainless steels.

Therefore, in recent years, in some of desulfurization equipment and the like, there have been used Ni based alloys having a markedly better corrosion resistance to sulfuric acid in comparison with Fe based alloys. Concretely, commercial Ni based alloys containing Cr, Mo and W with 20% Cr-15% Mo-4% W as a basic chemical composition, such as Hastelloy C22 and Hastelloy C276 ("Hastelloy" is a trademark), the Ni based alloy containing 16 to 27% of Cr, 16 to 25% of Mo and 1.1 to 3.5% of Ta which is disclosed in the Patent Document 1 and so on have been used.

As highly corrosion-resistant alloys, for example, in the Patent Documents 2 and 3, austenitic alloys used in waste incinerators and the like are disclosed. An austenitic stainless steel for flue-gas desulfurization equipment and for seawater service, which is excellent in crevice corrosion resistance and hot workability, is disclosed in the Patent Document 4. Moreover, austenitic stainless steels excellent in high temperature corrosion resistance, which are suitable for seawater service and for heat exchangers of incinerators, are disclosed in the Patent Documents 5 and 6.

Furthermore, an austenitic steel welded joint and a welding material, which are excellent in resistance to weld cracking and corrosion resistance to sulfuric acid, are disclosed in the Patent Document 7. Moreover, in the Patent Document 8, a Ni—Cr—Mo—Cu alloy excellent in corrosion resistance to sulfuric acid and wet-treated phosphoric acid is disclosed.

Patent Document 1: JP 8-3666 A
Patent Document 2: JP 5-195126 A
Patent Document 3: JP 6-128699 A
Patent Document 4: JP 10-60603 A
Patent Document 5: JP 2002-96111 A
Patent Document 6: JP 2002-96171 A
Patent Document 7: JP 2001-107196 A
Patent Document 8: JP 2004-19005 A

DISCLOSURE OF THE INVENTION

Problems to be Solved by the Invention

Commercial Ni based alloys, such as Hastelloy C22 and Hastelloy C276, and the Ni based alloy proposed in the Patent Document 1 contain large amounts of expensive alloy elements and hence it is impossible to prevent cost increases. In addition, since all of these Ni based alloys have poor workability; it is difficult to work them into desired members.

Corrosion resistance in environments containing chlorides was only considered in all of the alloys and steels proposed in the Patent Documents 2 to 6, and no examination has been carried out as to their application to severe corrosive environments containing reducing acids, such as hydrochloric acid and sulfuric acid.

Furthermore, in the case of the materials proposed in the Patent Documents 7 and 8, no study has been carried out as to corrosion resistance including that to hydrochloric acid.

The present invention has been accomplished in view of the above-mentioned state of affairs. It is an objective of the present invention to provide a Ni based alloy which has excellent corrosion resistance equivalent to that of Ni based alloys having high Mo contents, such as Hastelloy C22 and Hastelloy C276, in severe corrosive environments containing reducing acids such as hydrochloric acid and sulfuric acid, has also excellent workability, and is inexpensive in addition.

Means for Solving the Problems

In order to accomplish the above-described objective, the present inventors made various studies and experiments. As a result, the present inventors first obtained the following findings (a) and (b).

(a) In environments containing reducing acids, such as hydrochloric acid and sulfuric acid, usually, passive films are not formed stably on the surfaces of a Ni based alloy and, therefore, general corrosion occurs. However, in the case of alloys with raised Mo contents, such as Hastelloy C22 and Hastelloy C276, thin and dense passive films are formed on the surfaces of Ni based alloys and, therefore, the corrosion resistance is improved.

(b) Increasing the Mo content of a Ni based alloy results in not only cost increases, but also deterioration in weldability and workability, since intermetallic compounds such as a sigma ($\sigma$) phase and so on may sometimes be formed due to the segregation of Mo.

Therefore, the present inventors studied Ni based alloys which keep good workability while providing corrosion resistance equivalent to that of Ni based alloys having high Mo contents, such as Hastelloy C22 and Hastelloy C276, by controlling the Mo content to 10% or less by mass percent and utilizing other elements. As a result, the inventors obtained the following finding (c).

(c) It is possible to cause thin and dense passive films to be formed on the surfaces of a Ni based alloy by including Cu.

Therefore, in order to decrease a cost, the present inventors further studied the corrosion resistance to sulfuric acid and the corrosion resistance to hydrochloric acid by using various Ni based alloys whose Ni contents are controlled to 40 to 60% by mass percent and which contain 20 to 30% of Cr, Cu and Mo with Ni—Cr—Cu—Mo as a basic composition. As a result, the present inventors obtained the following important finding (d).

(d) By ensuring not only that the Mo and Cu contents are individually controlled, but also that the contents of these elements satisfy 0.5 Cu+Mo≧6.5, it is possible to ensure excellent corrosion resistance against environments containing both sulfuric acid and hydrochloric acid.

The Ni based alloy according to the present invention has been accomplished on the basis of the findings described above.

The main points of the present invention are the Ni based alloys shown in the following [1] to [3].

[1] A Ni based alloy, which consists of by mass percent, C: not more than 0.03%, Si: 0.01 to 0.5%, Mn; 0.01 to 1.0%, P: not more than 0.03%, S: not more than 0.01%, Cr: not less than 20% to less than 30%, Ni; more than 40% to not more than 60%, Cu: more than 2% to not more than 5.0%, Mo: 4.0 to 10%, Al; 0.005 to 0.5% and N: more than 0.02% to not more than 0.3%, with the balance being Fe and impurities, and the following expression (1) is satisfied;

$$0.5Cu+Mo \geqq 6.5 \quad (1),$$

wherein each element symbol in the expression (1) represents the content by mass percent of the element concerned.

[2] The Ni based alloy according to the above [1], which further contains, by mass percent, W: not more than 10% in lieu of a part of Fe.

[3] The Ni based alloy according to the above [1] or [2], which further contains, by mass percent, one or more elements selected from Ca: not more than 0.01% and Mg: not more than 0.01% in lieu of a part of Fe.

The above-mentioned inventions [1] to [3] related to the Ni based alloy are referred to as "the present invention [1]" to "the present invention [3]", respectively, or collectively referred to as "the present invention".

Effects of the Invention

The Ni based alloy of the present invention has excellent corrosion resistance equivalent to that of Ni based alloys having high Mo contents, such as Hastelloy C22 and Hastelloy C276, in severe corrosive environments containing reducing acids, such as hydrochloric acid and sulfuric acid, together with excellent workability. For this reason, the Ni based alloy can be suitably used as a low-cost material for various kinds of structural members, such as those of air-cooled heat exchangers air fin coolers and air preheaters used in petroleum refineries, petrochemical plants and the like as well as those of flue-gas desulfurization equipment, flues, smokestacks and the like in thermal power stations.

BEST MODES FOR CARRYING OUT THE INVENTION

In the following, the Ni based alloy of the present invention will be described in detail. In the following description, the symbol "%" for the chemical composition of the Ni based alloy represents "% by mass" if not otherwise specified.

C: not more than 0.03%

C (carbon) combines with Cr contained in an alloy and precipitates as Cr carbides, which contribute to an improvement in high temperature strength, on the grain boundaries. However, if the content of C exceeds 0.03%, Cr depleted zones are formed in the vicinity of the grain boundaries. As a result, intergranular corrosion resistance deteriorates. Therefore, the content of C is set to not more than 0.03%. The content of C is more preferably not more than 0.02%.

In order to ensure the above-described effect of C, the content of C is preferably not less than 0.002%.

Si: 0.01 to 0.5%

Si (silicon) is an essential element for not only obtaining a deoxidizing effect but also increasing oxidation resistance. For this reason, a content of Si not less than 0.01% should be included. However, Si segregates on the grain boundaries and reacts with combustion slag containing chlorides, causing intergranular corrosion. In addition, an excessive Si content of more than 0.5% deteriorates mechanical properties such as ductility and so on. Therefore, the content of Si is set to 0.01 to 0.5%. The lower limit of the Si content is more preferably 0.1%, and the upper limit thereof is more preferably 0.4%.

Mn: 0.01 to 1.0%

Mn (manganese) is an austenite-forming element and has a deoxidizing effect. Moreover, Mn combines with S contained in an alloy and forms MnS, which improves hot workability. In order to ensure these effects, a content of Mn not less than 0.01% is necessary. However, if the Mn content exceeds 1.0%, workability deteriorates contrarily, and moreover, weldability is also impaired. Therefore, the content of Mn is set to 0.01 to 1.0%. The lower limit of the Mn content is more preferably 0.1%, and the upper limit thereof is more preferably 0.6%.

P: not more than 0.03%

P (phosphorus) is an impurity element coming from raw materials and so on. A high content of P impairs weldability and workability; in particular, when the content of P exceeds 0.03%, the deterioration of weldability and workability becomes remarkable. Therefore, the content of P is set to not more than 0.03%. The content of P is more preferably not more than 0.015%.

S: not more than 0.01%

S (sulfur) is also an impurity element coming from raw materials and so on. A high content of S impairs weldability and workability; in particular, when the content of S exceeds 0.01%, the deterioration of weldability and workability becomes remarkable. Therefore, the content of S is set to not more than 0.01%. The content of S is more preferably not more than 0.002%.

Cr: not less than 20% to less than 30%

Cr (chromium) has an effect of ensuring high temperature strength and corrosion resistance at high temperatures. In order to obtain these effects, a content of Cr not less than 20% is necessary. However, in the case of environments in which Cr is not passivated, such as hydrochloric acid environment and so on, Cr readily dissolves compared to Fe and Ni. For this reason, at a high Cr content level, in particular, at a Cr content level of not less than 30%, Cr may deteriorate corrosion resistance contrarily; and moreover, the deterioration of weldability and workability occurs. Therefore, the content of Cr is set to not less than 20% to less than 30%. The content range of Cr is more preferably not less than 20% to less than 25%.

Ni: more than 40% to not more than 60%

Ni (nickel) is an element which stabilizes the austenitic microstructure and is an essential element for ensuring corrosion resistance. However, if the content of Ni is not more than 40%, it is impossible to obtain the above-mentioned effect sufficiently. On the other hand, since Ni is an expensive element, at a high Ni content level, cost increases greatly; in particular, at a Ni content level of more than 60%, the effect of an improvement in corrosion resistance is small with respect to an increase of alloy cost, resulting in a very poor balance of "alloy cost to corrosion resistance". Therefore, the content of Ni is set to more than 40% to not more than 60%. The lower limit of the Ni content is more preferably 42%. The content of Ni is more preferably less than 50%.

Cu: more than 2.0% to not more than 5.0%

Cu (copper) is an indispensable element in order to improve the corrosion resistance to both sulfuric acid and hydrochloric acid of the Ni based alloy of the present invention. Cu also contributes to an improvement in high temperature strength. In order to obtain such effects, a content of Cu more than 2.0% is necessary. However, even if Cu is contained at a level of more than 5%, not only the above-described effects do not become great so much, but also the deterioration of weldability and/or workability occurs contrarily. For this reason, the content of Cu is set to more than 2.0% to not more than 5.0%. The content of Cu is more preferably more than 2.5% and further more preferably more than 3.0%. The upper limit of the Cu content is more preferably 4.5% and further more preferably 4.0%.

Mo: 4.0 to 10%

Together with Cu, Mo (molybdenum) is an indispensable element in order to improve the corrosion resistance to both sulfuric acid and to hydrochloric acid of the Ni based alloy of the present invention. Furthermore, Mo contributes also to an improvement in high temperature strength. In order to obtain such effects, a content of Mo not less than 4.0% is necessary. However, an excessive content of Mo promotes the precipitation of sigma (σ) phase and causes the deterioration of weldability and workability; in particular, when the content of Mo exceeds 10%, the deterioration of weldability and workability becomes remarkable. Therefore, the content of Mo is set to 4.0 to 10%. The lower limit of the Mo content is preferably 4.5%, and the upper limit thereof is preferably 8.0%. Furthermore, the lower limit of the Mo content is more preferably 5.0%, and the upper limit thereof is more preferably 7.0%.

Al: 0.005 to 0.5%

In order to obtain a deoxidizing effect, it is necessary that the content of Al be not less than 0.005%. However, when Al is included at a content exceeding 0.5%, the above effect is saturated and the alloy cost increases. In addition, the deterioration of hot workability occurs. Therefore, the content of Al is set to 0.005 to 0.5%. The lower limit of the Al content is more preferably 0.03%, and the upper limit thereof is more preferably 0.3%.

N: more than 0.02% to not more than 0.3%

N (nitrogen) is one of the elements which contributes to the stabilization of the austenitic microstructure and enhances the pitting resistance. In order to obtain such effects, it is necessary that the content of N be exceeding 0.02%. However, an excessive content of N promotes nitrides to increase in number and causes the deterioration of hot workability; in particular, when the content of N exceeds 0.3%, the deterioration of hot workability becomes remarkable. Therefore, the content of N is set to more than 0.02% to not more than 0.3%. The lower limit of the N content is preferably more than 0.05%, and the upper limit thereof is preferably 0.2%. Furthermore, the lower limit of the N content is more preferably more than 0.08%, and still more preferably more than 0.10%.

Even when the contents of C, Si, Mn, P, S, Cr, Ni, Cu, Mo, Al and N are in the above-described ranges, there may be cases where it is impossible to ensure excellent corrosion resistance to both sulfuric acid and hydrochloric acid. For this reason, it is necessary that the Ni based alloy according to the present invention [1] satisfies the expression (1) in addition to the definition of the above-described ranges of content of each element;

$$0.5Cu+Mo \geqq 6.5 \quad (1),$$

wherein each element symbol in the above expression (1) represents the content by mass percent of the element concerned.

That is to say, when the contents of Cu and Mo are in the above-described ranges and further satisfy the above expression (1), it is possible to form passive films on the surfaces of the Ni based alloy in the environments of sulfuric acid and hydrochloric acid; and therefore, it becomes possible to ensure excellent corrosion resistance against both sulfuric acid and hydrochloric acid.

The value of the left side of the above expression (1), that is to say, [0.5Cu+Mo] is preferably not less than 7.0. The upper limit of the value of the left side of the expression (1) may be 12.5, which is expected in the case where the Cu content and the Mo content are at their respective upper limits of 5.0% and 10%.

The balance of the Ni based alloy according to the present invention [1] is composed of Fe and other impurity elements which come from various factors of the manufacturing process. That is to say, the main component of the balance of the present invention [1] is composed of Fe. In the following, this fact is explained.

Fe (iron) has the effect of ensuring the strength of a Ni based alloy and also reducing the content of Ni in order to decrease the cost of the alloy. For this reason, in the Ni based alloy according to the present invention, it is defined that the balance is composed of Fe and impurities. The upper limit of the content of Fe, which is the main component of the balance, may have values close to 32.4%, which is expected in the case where the contents of Si, Mn, Cr, Ni, Cu, Al and N have respective values of the lower limits of the above-described ranges, the all of contents of C, P and S have values close to 0, and the Mo content has values close to 5.5% (namely, the value of the right side of the expression (1) mentioned above is 6.5).

From the reasons mentioned above, it is defined that the Ni based alloy according to the present invention [1] consists of the elements of C to N in the above-described ranges, with the balance being Fe and impurities, and the above expression [1] is satisfied.

The Ni based alloy of the present invention may further contain, in lieu of a part of Fe, according to need, one or more elements selected from among W, Ca and Mg.

The above-mentioned optional elements will be explained below.

W: not more than 10%

W (tungsten) is an element which has effects of improving the pitting resistance and enhancing the high temperature strength. Therefore, in order to obtain these effects, W may also be included. Cr and Mo promote the formation of sigma (σ) phase, and thereby the weldability and workability deteriorate. However, by containing W, which has an action and effect similar to those of Mo with respect to the pitting resistance and high temperature strength, it is possible to prevent the deterioration of weldability and workability due to the formation of sigma (σ) phase. On the other hand, an excessive content of W, in particular, a content of W exceeds 10%, also induces the deterioration of weldability and workability. Therefore, when W is included, the content of W is set to not more than 10%.

In order to ensure the above effects of W, the content of W is preferably not less than 0.02%. For this reason, when W is included, the content of W is preferably 0.02 to 10%. If W is included, the lower limit of the W content is more preferably 0.2%, and the upper limit thereof is more preferably 8.0%. The upper limit of the W content is further more preferably 6.0%.

Ca and Mg are elements which have an effect of improving the hot workability. Therefore, in order to obtain this effect, the above elements may be included. The above-described Ca and Mg will be explained below.

Ca: not more than 0.01%

Ca (calcium) has an effect of improving the hot workability. However, a Ca content which exceeds 0.01% impairs mechanical properties such as toughness and so on, since the cleanliness of the alloy decreases remarkably. For this reason, when Ca is included, the content of Ca is set to not more than 0.01%.

In order to ensure the above effect of Ca, the content of Ca is preferably not less than 0.0005%. For this reason, when Ca is included, the content of Ca is preferably 0.0005 to 0.01%. If Ca is included, the upper limit of the Ca content is more preferably 0.005%.

Mg: not more than 0.01%

Mg (magnesium) also has an effect of improving the hot workability. However, a Mg content which exceeds 0.01% impairs mechanical properties such as toughness and so on, since the cleanliness of the alloy decreases remarkably. For this reason, when Mg is included, the content of Mg is set to not more than 0.01%.

In order to ensure the above effect of Mg, the content of Mg is preferably not less than 0.0005%. For this reason, when Mg is included, the content of Mg is preferably 0.0005 to 0.01%. If Mg is included, the upper limit of the Mg content is more preferably 0.005%.

shapes, such as not only plates, but also seamless tubes and pipes, welded tubes and pipes, further bars and so on, by using means such as melting, casting, hot working, cold working, welding and so on. Furthermore, in order to obtain desired mechanical properties, a heat treatment such as solution treatment and so on may also be performed after forming.

The following examples illustrate the present invention more specifically. These examples are, however, by no means limited to the scope of the present invention.

Examples

Various Ni based alloys having the chemical compositions shown in Table 1 were melted using a high-frequency heating vacuum furnace, and plates having a thickness of 15 mm were obtained by usual methods, namely, by performing a hot forging, a hot rolling and a cold rolling. After such treatments, a solution heat treatment was performed at 1150° C. and, thereafter specimens having a thickness of 2 mm, a width of 10 mm and a length of 50 mm were produced by machining.

The alloys 1 to 5 shown in Table 1 are Ni based alloys having chemical compositions which fall within the range regulated by the present invention. On the other hands, the alloys 6 to 15 are Ni based alloys of comparative examples whose chemical compositions are out of the range regulated by the present invention. Among the Ni based alloys of the comparative examples, the alloy 6 and the alloy 7 are Ni based alloys correspond to Hastelloy C276 and Hastelloy C22, respectively.

TABLE 1

| | | Chemical composition (% by mass) Balance: Fe and impurities | | | | | | | | | | | | | | |
|---|---|---|---|---|---|---|---|---|---|---|---|---|---|---|---|---|
| Classification | Alloy No. | C | Si | Mn | P | S | Cu | Ni | Cr | Mo | Al | N | W | Ca | Mg | Left side of expression (1) |
| Inventive example | 1 | 0.006 | 0.17 | 0.39 | 0.003 | 0.0007 | 2.99 | 46.30 | 23.00 | 6.02 | 0.045 | 0.052 | 6.30 | — | — | 7.52 |
| | 2 | 0.006 | 0.19 | 0.23 | 0.003 | 0.0006 | 3.01 | 45.83 | 22.83 | 5.87 | 0.078 | 0.144 | 6.37 | — | — | 7.38 |
| | 3 | 0.006 | 0.20 | 0.23 | 0.004 | 0.0007 | 3.06 | 45.79 | 22.73 | 5.88 | 0.080 | 0.112 | — | — | — | 7.38 |
| | 4 | 0.006 | 0.18 | 0.23 | 0.003 | 0.0006 | 3.01 | 46.15 | 22.71 | 5.88 | 0.084 | 0.119 | 3.77 | 0.0005 | 0.0008 | 7.50 |
| | 5 | 0.007 | 0.15 | 0.22 | 0.014 | 0.0004 | 2.88 | 46.35 | 22.35 | 5.75 | 0.085 | 0.094 | 3.87 | 0.0019 | — | 7.19 |
| Comparative example | 6 | 0.002 | 0.07 | 0.41 | 0.008 | 0.0002 | *0.13 | 57.95 | *15.40 | *15.65 | 0.210 | *0.003 | 3.38 | — | — | 15.72 |
| | 7 | 0.003 | 0.04 | 0.11 | 0.006 | 0.0002 | *0.15 | 58.35 | 21.00 | *13.49 | 0.190 | *0.010 | 2.71 | — | — | 13.57 |
| | 8 | 0.009 | 0.23 | 0.41 | 0.001 | 0.0010 | 3.02 | 46.32 | 22.98 | *— | 0.061 | 0.067 | 7.13 | 0.0020 | — | *1.51 |
| | 9 | 0.008 | 0.21 | 0.42 | 0.001 | 0.0010 | *1.04 | 45.93 | 22.85 | *3.05 | 0.064 | 0.139 | 6.87 | 0.0019 | — | *3.57 |
| | 10 | 0.007 | 0.22 | 0.42 | 0.001 | 0.0010 | *1.04 | 49.98 | 26.20 | *— | 0.057 | 0.123 | 7.28 | 0.0021 | — | *0.52 |
| | 11 | 0.006 | 0.18 | 0.23 | 0.003 | 0.0006 | 3.05 | 45.93 | 22.63 | *2.94 | 0.093 | 0.107 | — | — | — | *4.47 |
| | 12 | 0.005 | 0.17 | 0.39 | 0.003 | 0.0006 | 2.95 | 46.25 | 23.10 | *3.07 | 0.046 | 0.038 | 6.85 | — | — | *4.55 |
| | 13 | 0.006 | 0.21 | 0.21 | 0.005 | 0.0007 | 4.93 | 45.98 | 23.01 | *3.73 | 0.082 | 0.077 | 0.39 | 0.0009 | — | *6.20 |
| | 14 | 0.008 | 0.18 | 0.20 | 0.004 | 0.0009 | 2.41 | 46.03 | 22.81 | 5.09 | 0.079 | 0.063 | 0.41 | 0.0008 | — | *6.29 |
| | 15 | 0.007 | 0.17 | 0.22 | 0.016 | 0.0004 | 2.94 | 46.95 | 22.70 | 4.90 | 0.085 | 0.092 | 2.56 | 0.0043 | — | *6.37 |

Left side of expression (1): 0.5Cu + Mo

The mark * indicates falling outside the conditions regulated by the present invention.

The above-described elements, namely Ca and Mg, may be included singly as only either of these elements or compositely as both elements. If these elements are included, the total content thereof is preferably not more than 0.015%.

From the reasons mentioned above, the Ni based alloy according to the present invention [2] is defined as the one which further contains W: not more than 10% in lieu of a part of Fe in the Ni based alloy according to the present invention [1].

Similarly, the Ni based alloy according to the present invention [3] is defined as the one which further contains one or more elements selected from Ca: not more than 0.01% and Mg: not more than 0.01% in lieu of a part of Fe in the Ni based alloys according to the present invention [1] or [2].

The Ni based alloys according to the present invention [1] to the present invention [3] may be formed into desired The thus obtained 2 mm thick specimens of each Ni based alloy were tested by immersing in 3 mass % of hydrochloric acid at 60° C. for 6 hours, and in 20 mass % of sulfuric acid at 80° C. for 24 hours, respectively.

The deposits on the surfaces of the specimens after the immersion in the above hydrochloric acid were removed, and thereafter, each reduced mass was measured from the mass differences before and after the test, and each corrosion rate was calculated to evaluate the corrosion resistance to hydrochloric acid.

Similarly, the deposits on the surfaces of the specimens after the immersion in the above sulfuric acid were removed, and thereafter, each reduced mass was measured from the mass differences before and after the test, and each corrosion rate was calculated to evaluate the corrosion resistance to sulfuric acid.

The investigation results of the corrosion resistance to both sulfuric acid and hydrochloric acid are shown in Table 2.

TABLE 2

| Classification | Test No. | Alloy No. | Corrosion resistance to hydrochloric acid (mm/year) | Corrosion resistance to sulfuric acid (mm/year) |
|---|---|---|---|---|
| Inventive example | 1 | 1 | 0.04 | 0.01 |
| | 2 | 2 | 0.01 | 0.03 |
| | 3 | 3 | 0.02 | 0.02 |
| | 4 | 4 | 0.02 | 0.03 |
| | 5 | 5 | 0.03 | 0.02 |
| Comparative example | 6 | * 6 | 0.03 | 0.06 |
| | 7 | * 7 | 0.02 | 0.03 |
| | 8 | * 8 | 0.70 | 0.34 |
| | 9 | * 9 | 1.91 | 0.35 |
| | 10 | * 10 | 0.96 | 0.79 |
| | 11 | * 11 | 1.17 | 0.22 |
| | 12 | * 12 | 1.64 | 0.08 |
| | 13 | * 13 | 1.24 | 0.03 |
| | 14 | * 14 | 1.47 | 0.02 |
| | 15 | * 15 | 1.63 | 0.03 |

In the columns of "Hydrochloric acid corrosion resistance" and "Sulfuric acid corrosion resistance", each reduced mass was measured from the mass differences before and after the test, and each corrosion rate was calculated.
The mark * indicates falling outside the conditions regulated by the present invention.

From Table 2, it is apparent that in the case of Test Nos. 1 to 5 of the inventive examples in which the Ni based alloys 1 to 5 satisfying the conditions regulated by the present invention were used, the excellent corrosion resistance (that is to say, excellent corrosion resistance to both sulfuric acid and hydrochloric acid) were obtained; namely, the excellent corrosion resistance being equivalent to that of Test Nos. 6 and 7 in which Hastelloy C276 and Hastelloy C22, respectively were used, were obtained.

On the contrary, when the contents of Cu and Mo do not satisfy the expression (1), it is apparent that in both the Ni based alloys in which the content range of each element satisfies the range regulated by the present invention (the alloys 14 and 15 of Test Nos. 14 and 15) and those in which the content range of each element does not satisfy the regulated range (the alloys 8 to 13 of Test Nos. 8 to 13), the corrosion rate of at least either of corrosion resistance to hydrochloric acid or sulfuric acid increases compared to Test Nos. 6 and 7, in which Hastelloy C276 and Hastelloy C22 were used respectively. As mentioned above, when the contents of Cu and Mo of the Ni based alloy do not satisfy the expression (1), the corrosion resistance of the said alloy is poor.

On the Ni based alloys 1 to 5 which satisfy the conditions regulated by the present invention, a high temperature tensile test was separately conducted by using a thermorester testing machine to investigate the hot workability. As a result, it was ascertained that the hot workability thereof is good.

INDUSTRIAL APPLICABILITY

The Ni based alloy of the present invention has excellent corrosion resistance equivalent to that of Ni based alloys having high Mo contents, such as Hastelloy C22 and Hastelloy C276, in severe corrosive environments containing reducing acids, such as hydrochloric acid and sulfuric acid, together with excellent workability. For this reason, the Ni based alloy can be suitably used as a low-cost material for various kinds of structural members, such as those of air-cooled heat exchangers and air preheaters used in petroleum refineries, petrochemical plants and the like as well as those of flue-gas desulfurization equipment, flues, smokestacks and the like in thermal power stations.

What is claimed is:

1. A Ni based alloy, which consists of by mass percent, C: not more than 0.03%, Si: 0.01 to 0.5%, Mn: 0.01 to 1.0%, P: not more than 0.03%, S: not more than 0.01%, Cr: not less than 20% to less than 30%, Ni: more than 40% to less than 50%, Cu: more than 3.0% to not more than 5.0%, Mo: 5.0 to 10%, Al: 0.005 to 0.5%, W: 3.77 to 10%, and N: more than 0.02% to not more than 0.3%, with the balance being Fe and impurities, and the following expression (1) is satisfied;

$$0.5Cu+Mo \geqq 7.0 \quad (1)$$

wherein each element symbol in the expression (1) represents the content by mass percent of the element concerned.

2. A Ni based alloy, which consists of by mass percent, C: not more than 0.03%, Si: 0.01 to 0.5%, Mn: 0.01 to 1.0%, P: not more than 0.03%, S: not more than 0.01%, Cr: not less than 20% to less than 30%, Ni: more than 40% to less than 50%, Cu: more than 3.0 to not more than 5.0%, Mo: 5.0 to 10%, Al: 0.005 to 0.5%, W: 3.77 to 10%, N: more than 0.02% to not more than 0.3%, and one or more elements selected from Ca: not more than 0.01% and Mg: not more than 0.01%, with the balance being Fe and impurities, and the following expression (1) is satisfied;

$$0.5Cu+Mo \geqq 7.0 \quad (1)$$

wherein each element symbol in the expression (1) represents the content by mass percent of the element concerned.

* * * * *